United States Patent [19]

Chevillard et al.

[11] Patent Number: 4,609,218

[45] Date of Patent: Sep. 2, 1986

[54] PLASTIC SEAL

[75] Inventors: Paul F. Chevillard, Terrebonne; Victor R. Tritton; Gary E. Tritton, both of Pointe Claire, all of Canada

[73] Assignee: Les Enterprises Tritton LTEE, Montreal, Canada

[21] Appl. No.: 561,460

[22] Filed: Dec. 14, 1983

[30] Foreign Application Priority Data

Aug. 24, 1983 [CA] Canada ..... 435262

[51] Int. Cl.[4] ..... B65D 27/30; B65D 33/34; B65D 55/06

[52] U.S. Cl. ..... 292/320; 24/16 PB

[58] Field of Search ..... 292/318–322, 292/328, 329, 307 A, 307 R, 327; 24/16 PB, 16 R, 30.5 P, 30.5 R, 704, 161

[56] References Cited

U.S. PATENT DOCUMENTS

| | | | |
|---|---|---|---|
| 1,054,440 | 2/1913 | Murray | 292/320 |
| 3,128,114 | 4/1964 | Nierhaus . | |
| 3,146,012 | 8/1964 | King . | |
| 3,290,080 | 12/1966 | Dawson | 292/322 |
| 3,466,077 | 9/1969 | Moberg | 292/322 |
| 3,730,578 | 5/1973 | Gerlach . | |
| 3,954,295 | 5/1976 | Harley | 292/319 |
| 4,059,300 | 11/1977 | Moberg et al. . | |
| 4,229,031 | 10/1980 | Guiler | 292/322 |
| 4,248,462 | 2/1981 | Choi . | |

FOREIGN PATENT DOCUMENTS

| | | | |
|---|---|---|---|
| 858174 | 12/1970 | Canada . | |
| 994992 | 8/1976 | Canada . | |
| 1038602 | 9/1978 | Canada . | |
| 2115354 | 9/1983 | United Kingdom | 292/307 R |

*Primary Examiner*—Gary L. Smith
*Assistant Examiner*—Russell W. Illich
*Attorney, Agent, or Firm*—Russell, Georges, Breneman, Hellwege & Yee

[57] ABSTRACT

This invention provides a locking seal which comprises a socket member, a latch member and a locking cap member. The socket member comprises a body having first and second open ends communicating with a hollow portion extending through the body; and at least one locking finger extending towards the second end of the body. The latch member comprises an elongated locking end adapted for insertion into the hollow portion of the body and to interlock with the locking finger. The locking end comprises a first section having a surface tapering into a second section and defining with the second section at least one shoulder. The locking cap member comprises a closure member adapted to matingly engage the latch member and prevent access to the second end. The seal of this invention is suitable for use in securing or locking trucks, containers, etc.

16 Claims, 6 Drawing Figures

PLASTIC SEAL

This invention relates to a seal for locking trucks, containers and the like.

More particularly, the invention provides a plastic seal which eliminates the possibility of tampering by unauthorized parties without leaving some indication that tampering has occurred.

Seals for use in securing or locking trucks, containers, etc., are known in the art. However, many of these seals have the disadvantage that they can be tampered with, for example, by unauthorized parties, and then restored to their original condition without leaving any trace of such tampering so that detection of the unauthorized entry into the locked container, is virtually precluded.

Typical of such seals include a socket member and a locking head which is inserted into the socket member to engage in locking relationship with locking means provided in the socket member. However, such seals include a socket member which is open at both ends so that when the seal is in a locked position, tampering may occur from the open end of the socket member. In addition, the configuration of such seals often permits rotational movement of the locking head within the socket so that eventual damage to the locking means in the socket occurs, thereby permitting tampering.

With this invention, applicant has developed a seal which is simple to manufacture and use, but which overcomes the disadvantages mentioned above with the prior art seals. Thus, a seal is provided which eliminates the possibility of tampering and possibly opening of the seal, without leaving some indication that such unauthorized tampering has occurred.

The locking seal of this invention, in one embodiment thereof, comprises a socket member, a latch member and a locking cap member. The socket member comprises a body which has first and second open ends communicating with a hollow portion extending through the body and at least one locking finger extending towards the second end of the body. The latch member comprises an elongated locking end adapted for insertion into the hollow portion of the body and to interlock with the locking finger. The locking end comprises a first section having a surface tapering into a second section and defining with the second section at least one shoulder. The locking cap member comprises a closure member adapted to matingly engage the latch member and prevent access to the second end.

In preferred embodiments of this invention, the socket member includes an annular rib around the inner circumference thereof, the rib defining a lip in the body adjacent to and facing the first end of the body, and spaced from the first end.

Still further, in a preferred form, the locking finger extends from the inner side of the annular rib downwardly towards the second end. Preferably, two such locking fingers are provided in diametrically opposed relationship, extending downwardly and inwardly of the bore—that is, towards each other so that a restricted opening is created between the free ends of the downwardly extending fingers.

At the second end of the socket member, it is desirable to provide a concentric annular recess which defines a shoulder adjacent to and spaced from the second end. This shoulder is adapted to receive a portion of the locking cap member in seating relationship therewith.

The latch member, in its preferred form, includes three tapering sections, the first and second defining one shoulder, and the second and third sections defining another shoulder. In addition, the first section preferably extends from a collar constituted by a pair of opposed jutting surfaces adapted to sit on the lip formed by the rib in the socket member, when the seal is in a locked position. Also, the first section desirably extends from the collar with its opposed surfaces substantially parallel before tapering towards each other to merge with the second section. The opposed, substantially parallel surfaces of the first section preferably extend for a distance equalling the length of the rib in the socket member. Correspondingly, the fingers of the socket member are preferably of a length approximating the tapered portion of the first section so that upon insertion of the latch member into the socket, the fingers sit on the shoulders formed by the first and second sections of the latch member and the opposed, substantially parallel surfaces of the first section meet the surface of the annular rib.

Usually, the latch and socket member are provided with some sort of joining means so that the latch member is at one end thereof and the socket member at the other end thereof. Such joining means may be of the same material as the latch and socket member and may be provided in the form of a relatively thin, flexible, flat strap member.

The cap member is adapted to interlockingly engage the latch member within the socket and to close-up the second end of the socket so that unauthorized access is not possible from the second end. To this end, the cap member preferably comprises a disc-shaped head portion which will fit within the annular recess provided at the second end of the socket. A pair of opposed arms having locking lugs in facing relationship to each other is also preferably included between which arms, a restricted passage is provided by virtue of the locking lugs. These locking lugs lockingly engage with the second shoulder on the latch member provided by the second and third sections so that the third section of the latch member extends between the arms of the locking cap, while the lugs are seated on the second shoulders of the latch member.

When inserted within the socket member, the locking cap preferably constitutes a flush surface with the outer rim of the socket member so that no access into the socket member is possible. In addition, to obtain a more tamper-proof seal, the locking cap is ultrasonically sealed within the socket member, or sealed by other suitable means.

The seal of this invention may be made of any suitable plastic material such as polyolefins, e.g. polyethylene, polypropylene, copolymers of these materials, and the like.

Having thus generally described the invention, reference will now be made to the accompanying drawings, illustrating preferred embodiments, and in which.

Figures 1, 2, 3, 4, 5, 6:
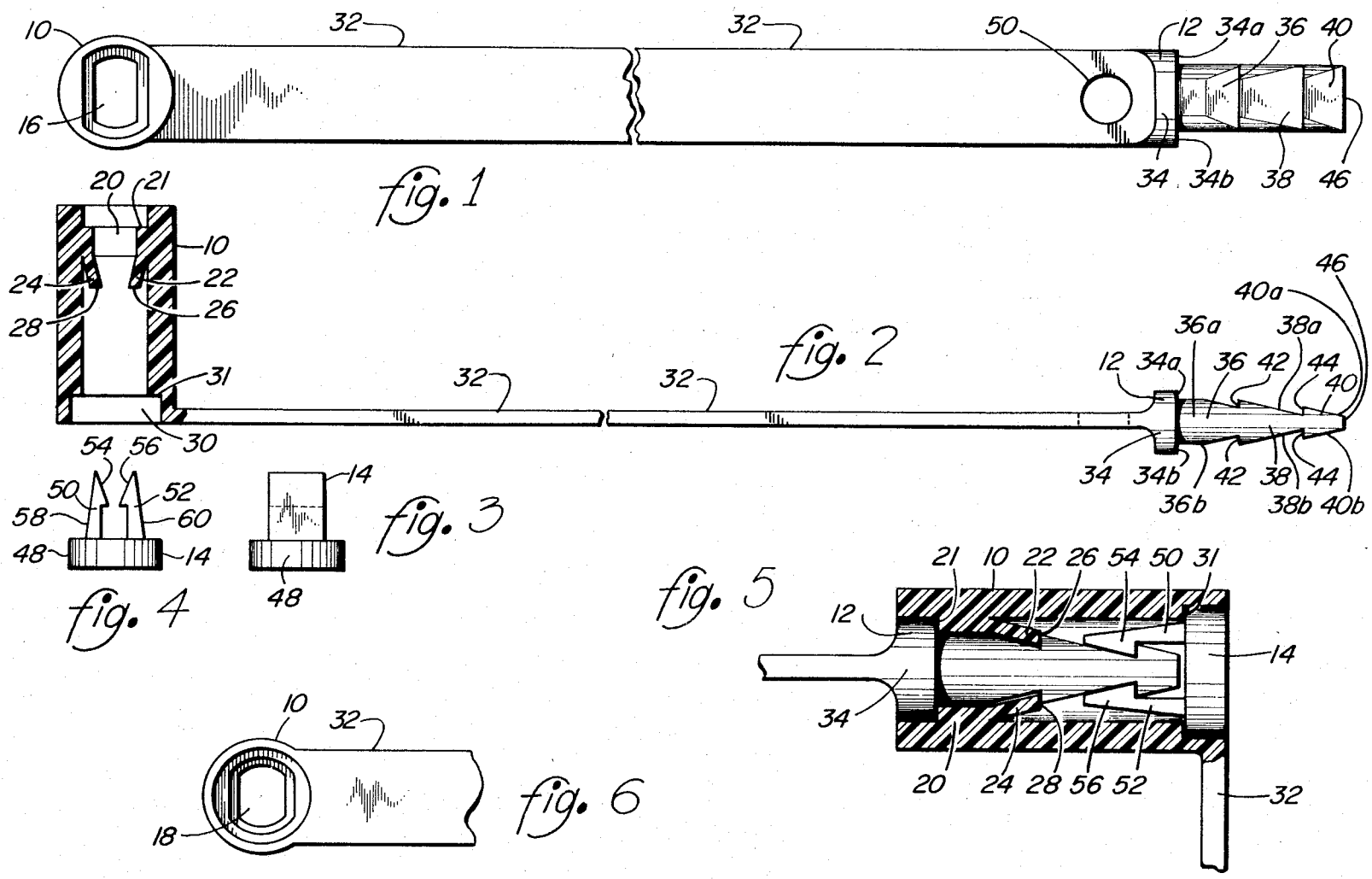
FIG. 1 illustrates the socket member and latch member of the present invention in front view.
FIG. 2 illustrates the socket member and latch member of the present invention in side view.
FIG. 3 illustrates the locking cap of this invention in front view.
FIG. 4 illustrates the locking cap of this invention in side view.
FIG. 5 is an exploded view of the latch member inserted in the socket member in conjunction with the locking cap.
FIG. 6 illustrates the socket member in rear view.

The locking seal of this invention, as will be seen from the drawings, comprises a simple, three-component device. More specifically, the locking seal comprises a socket member 10, a latch member 12, and a sealing cap 14.

In the illustrated embodiment, socket member 10 comprises a substantially tubular body having an inner configuration adapted to interlockingly mate with latch member 12. Socket member 10 has opposed open ends 16, 18 communicating with a hollow bore extending longitudinally through the body and having therein locking means which are engageable with corresponding parts on latch member 12, when latch member 12 is inserted therein, as will be discussed in greater detail hereinafter.

As will be seen, the locking means provided in socket member 10 comprises initially an annular rib 20 extending around the inside circumference of the body. The rib 20 has a substantially flat, planar surface constituting a raised area on the inner surface of the socket member 10 and provides an annular lip 21 inside the bore adjacent to and spaced from one end 16 of socket member 10. Rib 20, by virtue of lip 21, provides a seating surface for a corresponding portion of latch member 12, as will be evident from the following description. Rib 20 further has a pair of diametrically opposed locking fingers 22 and 24 extending from the inner end thereof, remote from the lip 21. Thus, fingers 22 and 24 extend from the bottom of rib 20 downwardly towards the opposed end 18 of the socket member 10, and inwardly of the bore.

Fingers 22 and 24 have free ends 26 and 28, respectively, which provide a restricted passage therebetween and which free ends 26 and 28, when in locking engagement with the latch member, sit on corresponding shoulders provided on the latch member 12. Fingers 26 and 28 comprise substantially flat, planar surfaces with, as mentioned above, free ends 26 and 28 directed inwardly towards each other, inwardly of the bore.

At the other end 18 of socket member 10, a concentric annular recess 30 is provided, thereby defining a further lip 31 in the bore of socket member 10 adjacent to and spaced from the end 18 of the socket member. Lip 31 provides a seating surface for the locking cap 14, as discussed hereinafter.

Socket member 10 is preferably provided with a joining means at one end thereof. In the illustrated embodiment, such means comprises extension 32 extending perpendicularly of socket member 10 at end 18 thereof. Extension 32 is a relatively thin, flat and basically flexible member which has, at its other end, latch member 12 adapted for insertion into socket member 10.

Turning now to latch member 12, this is provided with a substantially elongated configuration having locking portions which correspond with the inner configuration of socket member 10 so that insertion of latch member 12 into socket 10 effects locking of one within the other and prevents rotational movement of the latch within the socket. As such, latch member 12 has, at one end thereof, a collar 34 comprised of opposed surfaces **34*a*, 34*b* extending from either side of joining means 32. Collar 34, when the latch member is in locking engagement with the socket member, sits on lip 21 formed by the rib 20** in the socket.

Latch member 12 further comprises first, second and third locking sections, indicated by reference numerals 36, 38 and 40, extending from collar 34. As will be seen from the drawings, first section 36 comprises substantially flat, opposed surfaces **36*a*, 36*b* extending parallel to each other from the collar 34 and which then taper inwardly, in side view, to form shoulders 42 in conjunction with second section 38. Opposed surfaces 38*a*, 38*b* of second section 38 taper inwardly, in side view, to form, with third section 40, shoulders 44. Third section 40 has opposed surfaces 40*a* and 40*b* tapering towards each other to form flat, free end 46** of the latch member.

When latch member 12 is on locking engagement within socket number 10, surfaces **34*a*, 34*b* of collar 34 seat on lip 21 and shoulders 42 receive the free ends 26, 28 of locking fingers 22, 24. It will be noted from the drawings that the opposed surfaces 36*a*, 36*b* of section 36 extend parallel to each other for approximately the length of the rib 20 and then begin to taper towards each other in conjunction with the beginning of the locking fingers extending from rib 20. The locking fingers in turn have a length substantially corresponding to the tapering surfaces so that they matingly sit on the shoulders 42**.

Cap member 14 is adapted for insertion into end 18 of socket member 10 and to lockingly engage with the latch member 12, to prevent access or tampering from this end of the seal.

In the illustrated embodiment, sealing cap 14 comprises a disc-shaped head portion 48 which, when in the locking position with the socket and latch members, forms a flush, closed-in surface at end 18 of the seal. Sealing cap 14 has a pair of arms 50 and 52 extending from one surface of the disc-shaped head. Each arm 50 and 52 includes a thicker portion on one side thereof defining a locking lug 54, 56 in facing relationship to each other, thereby providing a restricted passage between the arms. The opposed, outer surfaces 58, 60 of arms 50 and 52 are substantially flat and planar.

As shown in the drawings, locking lugs 54 and 56 matingly engage with shoulders 44 so that section 40 of latch member 12 is held between the arms 50 and 52, while the surface of disc-shaped head 48 sits on lip 31 of socket member 10.

An optional feature of the product of the present invention is illustrated in FIG. 1, in which the member 32 is provided with an aperture 50 adjacent the latch member 12, which forms a point of weakness and is adapted to service a point of rupture in the event of tampering with the seal of the present invention. Aperture 50 is preferably spaced closely to the latch member 12 although this point of weakness could be further removed than being adjacent to the latch member 12. In addition, in place of an aperture, other means of providing a line of weakness or a rupturable point may be utilized—e.g. score lines, slit lines, or the like.

It will be appreciated that the fingers 22, 24 of socket member 10 and the arms 50, 52 of sealing cap 14 are of a somewhat yielding nature so that when the latch member is inserted through the restricted passages, the fingers 22, 24 and arms 50, 52 yield to allow for passage of the latch member, and then "snap" into position on the respective shoulders of the latch. Also, the arms 50 and 52 may have varying configurations with, for example, the lug portion 54 being separated by means of a channel from the opposed side of the arm while being connected at the other end (the pointed end).

It will be understood that various modifications can be made to the above described embodiment, without departing from the spirit and scope of the invention defined herein.

We claim:

1. A locking seal comprising a socket member, a latch member and a locking cap member;

said socket member comprising a body having first and second open ends communicating with a hollow portion extending through said body; and at least one locking finger extending towards said second end of said body;

said latch member comprising an elongated locking end adapted for insertion into said first end of said body; said locking end comprising a first section having a surface tapering into a second section and defining with said second section at least one first shoulder adapted to lockingly engage said at least one locking finger, said second section having a surface tapering into a third section and defining with said third section at least one second shoulder;

said locking cap member comprising a closure member adapted for insertion into said second end of said body to prevent access to said second end, said locking cap member having locking means extending therefrom adapted to lockingly engage said at least one second shoulder;

whereby, when said latch member is inserted into said hollow portion of said body, said locking means of said locking cap member directly locks said at least one second shoulder of said locking end of said latch member, and said at least one locking finger of said socket member lockingly engages said at least one first shoulder of said locking end of said latch member, thereby providing dual locking of said latch member in place.

2. A locking seal as defined in claim 1 wherein said socket member comprises a substantially tubular body and wherein said hollow portion comprises an elongated bore extending longitudinally through said body.

3. A locking seal as defined in claim 1 wherein said socket member further includes an annular rib defining a first lip in said hollow portion of said socket member adjacent to and facing said first end of said body and spaced from said first end.

4. A locking seal as defined in claim 3 wherein there is provided at least two locking fingers, said locking fingers extending from said rib inwardly of said hollow portion and downwardly towards said second end of said body.

5. A locking seal as defined in claim 4 wherein said locking fingers are arranged in diametrically opposed relationship.

6. A locking seal as defined in claim 4 wherein said first, second and third sections have opposed surfaces and define first and second shoulders on each opposed surface of said sections, the opposed surfaces of said first, second and third sections being of a generally flat, planar nature.

7. A locking seal as defined in claim 1 wherein said socket member further includes a concentric annular recess at said second end of said body defining a second lip in said hollow portion adjacent to and facing said second end and spaced from said second end.

8. A locking seal as defined in claim 7 wherein said locking cap member comprises a disc-shaped head portion having first and second opposed planar faces; said locking means of said locking cap member comprising first and second spaced apart arm members extending longitudinally from said first face of said head portion, each arm having an inwardly directed lug in facing relationship with each other at the free ends of said arm members and wherein said concentric annular recess at said second end of said body is dimensioned to receive said disc-shaped head portion of said locking cap member, whereby said head portion seats on said second lip and said second face of said head portion is in substantial flush alignment with the second end of said body.

9. A locking seal as defined in claim 1 wherein said locking cap member is ultrasonically sealed in said socket member.

10. A locking seal as defined in claim 1 further including joining means having said latch member and said socket member at opposed ends of said joining means.

11. A locking seal as defined in claim 10 wherein said joining means, said latch member and said socket member are of a one-piece integral construction.

12. A locking seal as defined in claim 10 wherein said joining means includes a point of weakness adjacent said latch member.

13. A locking seal as defined in claim 12 wherein said point of weakness comprises an aperture adjacent said latch member.

14. A locking seal as defined in claim 3 further including joining means having said latch member and said socket member at opposed ends of said joining means, said joining means comprising a flat, flexible extension, and wherein there is provided a collar adjacent said joining means and said first section of said latch member, said collar having opposed surfaces extending outwardly from each side of said joining means, said collar being dimensioned to seat on said first lip.

15. A locking seal as defined in claim 8 wherein said lugs comprise a triangular, thicker portion of said arms at the free ends thereof.

16. A locking seal as defined in claim 8 wherein said lugs are joined to said arms at the free ends thereof providing a channel between said arms and said lugs.

* * * * *